US007289076B2

(12) United States Patent
Tikhov et al.

(10) Patent No.: US 7,289,076 B2
(45) Date of Patent: Oct. 30, 2007

(54) SMALL PLANAR ANTENNA WITH ENHANCED BANDWIDTH AND SMALL STRIP RADIATOR

(75) Inventors: Yuri Tikhov, Suwon-si (KR); Young-hoon Min, Anyang-si (KR); Yong-jin Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/207,725

(22) Filed: Aug. 22, 2005

(65) Prior Publication Data

US 2006/0038725 A1 Feb. 23, 2006

(30) Foreign Application Priority Data

Aug. 21, 2004 (KR) ..... 10-2004-0066159
Jul. 8, 2005 (KR) ..... 10-2005-0061666

(51) Int. Cl.
*H01Q 13/10* (2006.01)

(52) U.S. Cl. ..... 343/770; 343/767

(58) Field of Classification Search ..... 343/767, 343/770, 768

See application file for complete search history.

(56) References Cited

U.S. PATENT DOCUMENTS 5,268,696 A * 12/1993 Buck et al. ..... 343/372
6,573,872 B2 * 6/2003 Oberschmidt et al. ..... 343/767
2003/0156065 A1 8/2003 Jo et al.
2005/0285809 A1 * 12/2005 Louzir et al. ..... 343/770

FOREIGN PATENT DOCUMENTS

EP 1 589 680 A1 10/2005
WO WO 03/034544 A1 4/2003
WO WO 03/094293 A1 11/2003
WO WO 2004/047222 A1 6/2004

OTHER PUBLICATIONS

Azadegan R et al:, "Design of miniaturized slot antennas", IEEE Antennas and Propagation Society International Symposium. 2001 Digest. APS. Boston, MA Jul. 8-13, 2001, New York, NY: IEEE, US, vol. 1 of 4, Jul. 8, 2001, pp. 565-568, XP010564702.
Korean Office Action dated Nov. 15, 2006 issued in corresponding KR Patent Application No. 2005-61666.

* cited by examiner

*Primary Examiner*—Hoanganh Le
(74) *Attorney, Agent, or Firm*—Sughrue Mion Pllc.

(57) ABSTRACT

A planar small antenna and a small strip radiator are provided which have increased bandwidth. The small strip radiator has a main strip pattern and a plurality of convoluted strip patterns terminating the main strip pattern at each end. The plurality of convoluted strip patterns are arranged in mirror-symmetrical arrangement with reference to the longitudinal axis of the main strip such that one pair of convoluted strip patterns is convoluted clockwise while another pair is convoluted counterclockwise. As a result, an electrically small antenna radiator requires less metal or conductive material than conventional radiators, and also can operate without adversely affecting the radiation characteristics of the antenna.

14 Claims, 13 Drawing Sheets

SMALL PLANAR ANTENNA WITH ENHANCED BANDWIDTH AND SMALL STRIP RADIATOR

CROSS-REFERENCE TO RELATED APPLICATIONS

This application claims priority from Korean Patent Application No. 2004-66159, filed on Aug. 21, 2004, and Korean Patent Application No. 2005-61666, filed on Jul. 8, 2005, the entire content of each are incorporated herein by reference.

BACKGROUND OF THE INVENTION

1. Field of the Invention

The present invention relates to RF and microwave antennas, and more particularly, to a small planar antenna and a small conductive strip radiator with improved bandwidth.

2. Description of the Related Art

In L-frequency bandwidth and at UHF frequencies, the size of a half wave dipole antenna presents a restriction in mobile or RFID applications, and therefore, a small antenna with relatively small wavelength is required. However, the size of antenna for a given application is not related mainly to the technology used, but is defined by well-known laws of physics. Namely, the antenna size with respect to the wavelength is the parameter that has the most significant influence on the radiation characteristics of the antenna.

Every antenna is used to transform a guided wave into a radiated one, and vice versa. Basically, to perform this transformation efficiently, the antenna size should be of the order of a half wavelength or larger. Of course, an antenna may be smaller than this size, but bandwidth, gain, and efficiency will decrease. Accordingly, the art of antenna miniaturization is always an art of compromise among size, bandwidth, and efficiency.

In the case of planar antennas, a good compromise may be obtained when most of the given antenna area participates in radiation.

WO 03/094293 discloses an example of miniaturizing the antenna to a size smaller than the size of resonance, while maintaining relatively high gain and efficiency of resonance characteristics. FIG. 1 shows an antenna of WO 03/094293, which is incorporated herein by reference.

Referring to FIG. 1, antenna 1 includes a dielectric substrate 2, a feed line 5, a metal layer 3, a main slot 4 and a plurality of sub slots 6*a* to 6*d* which are patterned within the metal layer 3. The metal layer 3 with the main slot 4 and sub slots 6*a* to 6*d* form a radiator of the antenna 1.

Meanwhile, FIG. 2 shows a radiator of a conventional antenna which has a vertically-linear slot. FIG. 3 shows a radiator of a conventional antenna with vertically-rotating slot, and FIG. 4 shows a radiator of a conventional antenna with a vertically-spiral slot.

Throughout the description with reference to FIGS. 2 to 4, the common components, that is, main slot and metal layer will be referred to by the same reference numerals. A plurality of sub slots 8*a* to 8*d*, 9*a* to 9*d*, 10*a* to 10*d* of various configurations, are formed at each end of the main slot 4.

A conventional antenna as exemplified above is limited by having narrow bandwidth. Furthermore, the operative frequency bandwidth of a small antenna is a factor in a variety of applications.

Accordingly a need arises for a small antenna, which can operate at an electrically-improved bandwidth, without affecting radiation pattern, gain and radiation efficiency.

Meanwhile, a small antenna requires a large amount of conductive material for a ground layer. Thus, the relatively high weight of conductive material required in antennas also becomes a factor.

SUMMARY OF THE INVENTION

Accordingly, an aspect of the present invention is to provide a planar small antenna which has an improved operative frequency bandwidth, and does not adversely affect radiation pattern, gain and radiation efficiency.

It is another aspect of the present invention to provide a small strip radiator which requires less metal or other conductive material than conventional radiators, and at the same time can operate without adversely affecting radiation characteristics.

The above and other aspects of the present invention can substantially be achieved by providing a planar small antenna, comprising a dielectric substrate, a metal layer formed on the upper part of the dielectric substrate, a main slot patterned within the metal layer, and a plurality of sub slots connected with the main slot, and convoluted in a predetermined direction. The plurality of sub slots may be arranged symmetrically with reference to the longitudinal axis of the main slot.

The predetermined direction may be a clockwise direction or a counterclockwise direction.

Each of the plurality of sub slots which are arranged symmetrically with reference to the longitudinal axis of the main slot, may be convoluted in direction opposite to a counterpart sub slot of said each of the plurality of sub slots.

Respective sectors of the convoluted sub slots may be smaller than ¼ of wavelength which is within the operational frequency range of the antenna.

The plurality of sub slots may include a first right sub slot convoluted clockwise, formed on a upper side of a right side of the main slot, a second right sub slot convoluted opposite to the first right sub slot, formed alongside the inner side of the first right sub slot, a fourth right sub slot convoluted opposite to the first right sub slot, formed on a lower side of the right side of the main slot, and a third right sub slot convoluted opposite to the fourth right sub slot, formed alongside the inner side of the fourth right sub slot.

First to fourth left sub slots may be further provided in a mirror-symmetric arrangement with the first to fourth right sub slots with reference to the main slot, wherein each of the first to fourth left sub slots is convoluted opposite to a counterpart sub slot of the first to fourth right sub slots.

The main slot may have a length smaller than a half wave in the operational frequency of the antenna.

The widths of the sub slots and the main slot may be identical.

The width of the sub slots may be narrower than the width of the main slot.

The width of the sub slots may be wider than the width of the main slot.

A feed line may be further provided at a rear side of the dielectric substrate, having a microstrip line of open-ended capacitive probe.

The widths of the probe and strips of the microstrip line may be identical.

The width of the probe may be narrower than the width of the strips of the microstrip line.

The width of the probe may be wider than the width of the strips of the microstrip line.

According to one aspect of the present invention, a small strip radiator may include a main strip pattern, and a plurality of convoluted strip patterns which terminate the main strip pattern at each end. The plurality of convoluted strip patterns may be arranged in mirror-symmetrical arrangement with reference to the longitudinal axis of the main strip such that one pair of convoluted strip patterns is convoluted in a clockwise direction while another pair is convoluted in a counterclockwise direction.

The main strip may have a centrally placed gap which is a feeding point of the radiator.

The main strip pattern and the plurality of convoluted strip patterns may be formed on the dielectric substrate.

The convoluted strip patterns may be provided in a mirror-symmetric arrangement with reference to the longitudinal axis of the main strip.

A feed may be further provided, with having a direct inlet of an electronic chip into the gap.

A feed may be further provided, with having a planar transmission line placed on the dielectric substrate.

The dielectric substrate, the main strip pattern and the convoluted strip patterns may be substantially planar.

The main strip pattern and the convoluted strip patterns formed as a bulk wire pattern having the same geometry.

BRIEF DESCRIPTION OF THE DRAWINGS

The above aspects of the present invention will be more apparent by describing certain exemplary embodiments of the present invention with reference to the accompanying drawings, in which.

DETAILED DESCRIPTION OF THE EXEMPLARY EMBODIMENTS OF THE INVENTION

Exemplary embodiments of the present invention will be described herein below with reference to the accompanying drawings.

Figure 5:
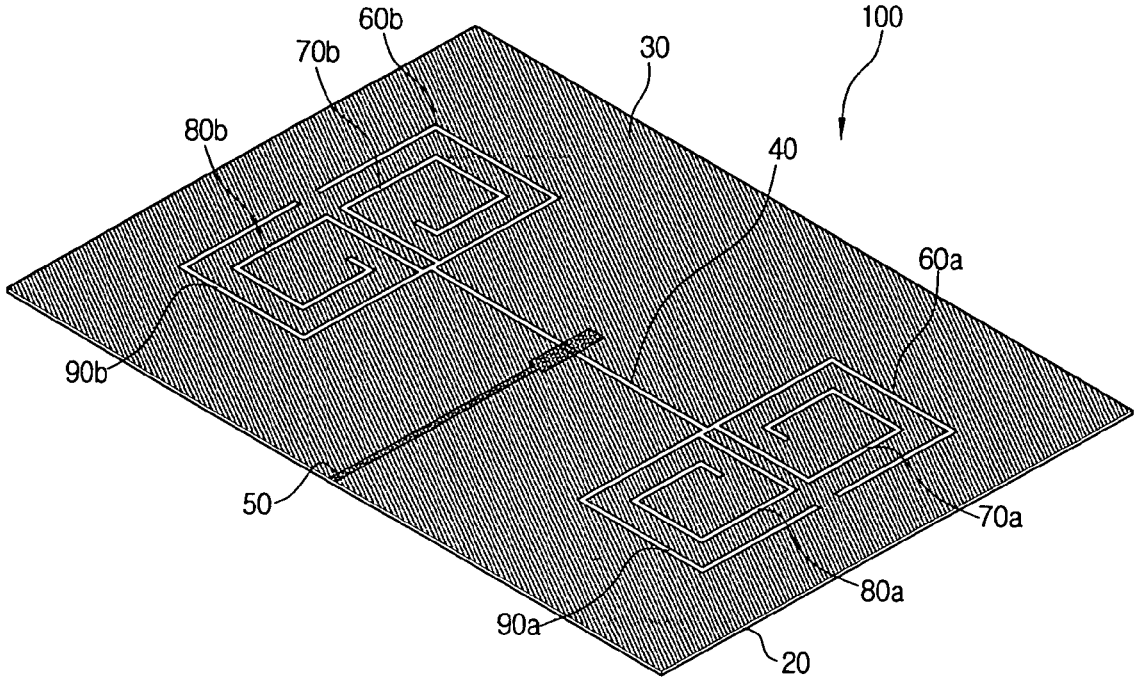
FIG. 5 is a perspective view of a planar small antenna according to an exemplary embodiment of the present invention.

FIG. 5 is a perspective view of a planar small antenna according to an exemplary embodiment of the present invention. Referring to FIG. 5, a planar small antenna 100 according to an exemplary embodiment of the present invention includes a dielectric substrate 20, a metal layer 30 formed on an upper part of the dielectric substrate 20, a main slot 40 and a plurality of sub slots 60*a*, 60*b*, 70*a*, 70*b*, 80*a*, 80*b*, 90*a*, 90*b* which are patterned in the metal layer 30, and a feed line 50 which is formed at a lower part of the dielectric substrate 20. The metal layer 30 with the main slot 40 and the plurality of sub slots 60*a*, 60*b*, 70*a*, 70*b*, 80*a*, 80*b*, 90*a*, 90*b* form the radiator of the antenna 100.

Figure 6:
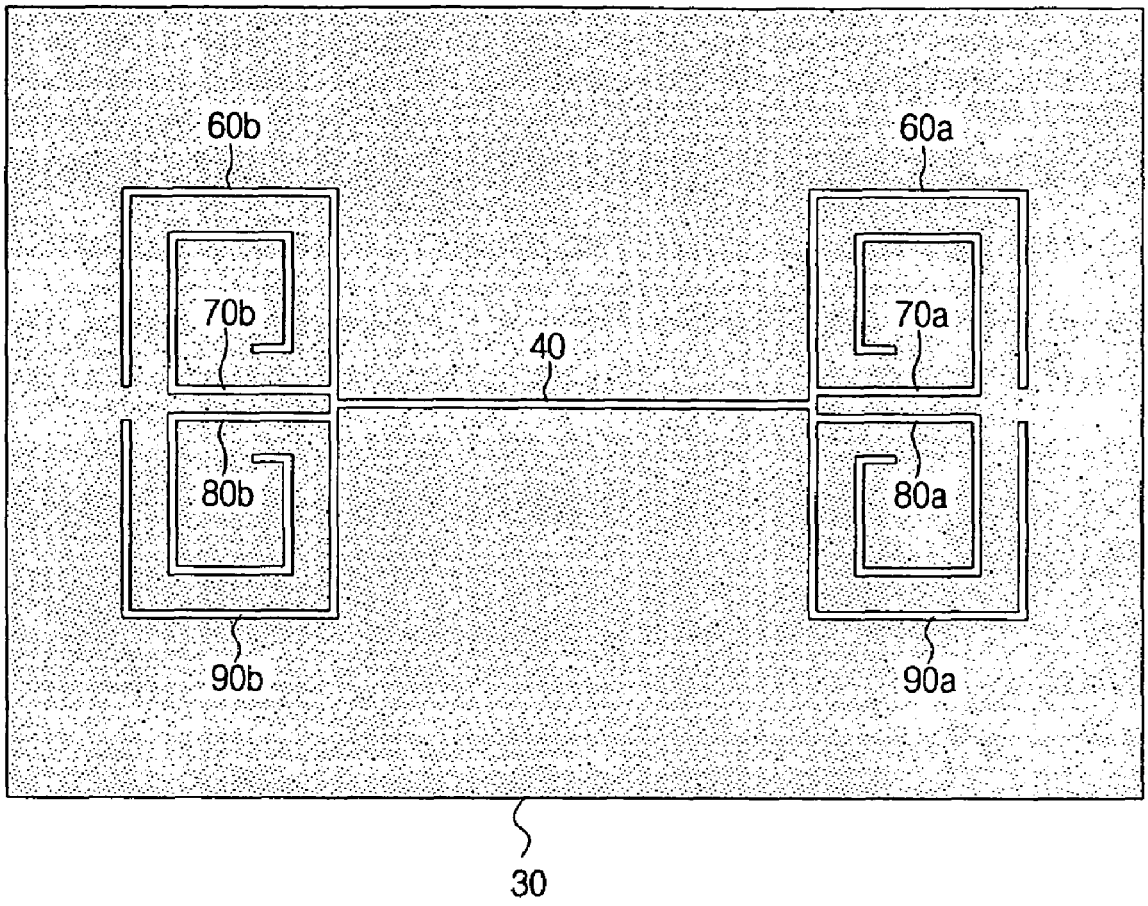
FIG. 6 is a detailed plan view of the metal layer of FIG. 5 which has a main slot and a plurality of sub slots therein.

FIG. 6 is a detailed plan view of the metal layer 30 which has the main slot 40 and sub slots 60*a*, 60*b*, 70*a*, 70*b*, 80*a*, 80*b*, 90*a*, 90*b* of FIG. 5. Hereinbelow, the main slot 40 and sub slots 60*a*, 60*b*, 70*a*, 70*b*, 80*a*, 80*b*, 90*a*, 90*b* together are referred to as a 'radiator'.

Referring to FIG. 6, the radiator includes the metal layer 30, a main slot 40 and the plurality of sub slots 60*a*, 60*b*, 70*a*, 70*b*, 80*a*, 80*b*, 90*a*, 90*b* which are formed on both sides of the main slot 40.

Each of the sub slots 60*a*, 60*b*, 70*a*, 70*b*, 80*a*, 80*b*, 90*a*, 90*b* is connected with the main slot 40. Also, each of the sub slots 60*a*, 60*b*, 70*a*, 70*b*, 80*a*, 80*b*, 90*a*, 90*b* are convoluted in clockwise or counterclockwise directions. Additionally, each of the sub slots 60*a*, 60*b*, 70*a*, 70*b*, 80*a*, 80*b*, 90*a*, 90*b* are arranged in a mirror-symmetric pattern with reference to the longitudinal axis of the main slot 40.

Accordingly, the first sub slot 60*a* on the right side and the third sub slot 80*a* on the right side may be convoluted clockwise, while the second sub slot 70*a* on the right side and the fourth sub slot 90*a* on the right side may be convoluted counterclockwise.

Further, the first sub slot 60*b* on the left side and the third sub slot 80*b* on the left side may be convoluted counterclockwise, while the second sub slot 70*b* on the left side and the fourth sub slot 90*b* on the left side may be convoluted clockwise.

Basically, a radiating part dominates over the electromagnetic properties of every antenna. Thus, when a greater area of the radiator is used for radiation, the operative bandwidth can be improved and antenna miniaturization can be achieved, without diminishing desirable radiation characteristics, such as gain and radiation efficiency.

Unlike the slot pattern of conventional antennas, the radiator according to an exemplary embodiment of the present invention includes four sub slots which are respectively formed on ends of the main slot 40, in a mirror-symmetrical structure with reference to the longitudinal axis of the main slot. The planar small antenna according to this exemplary embodiment has the above rather complicated slot structure for the following reasons.

Generally, the total length of an antenna is smaller than a half wavelength, and may be even smaller than a quarter of the wavelength, which inevitably causes the main slot to have a shortened size. In addition, the radiator of an antenna is required to maintain a half wave resonance characteristic. Accordingly, in order to reduce the size of the antenna, a certain limit voltage may be applied to both ends of the main slot, and therefore, a desired resonance electromagnetic field distribution is generated at the shortened main shot. In order to provide desired discontinuity of voltage at both ends of the main slot, both terminating ends of a sub slot need termination elements which have an inductive characteristic.

Figure 1:
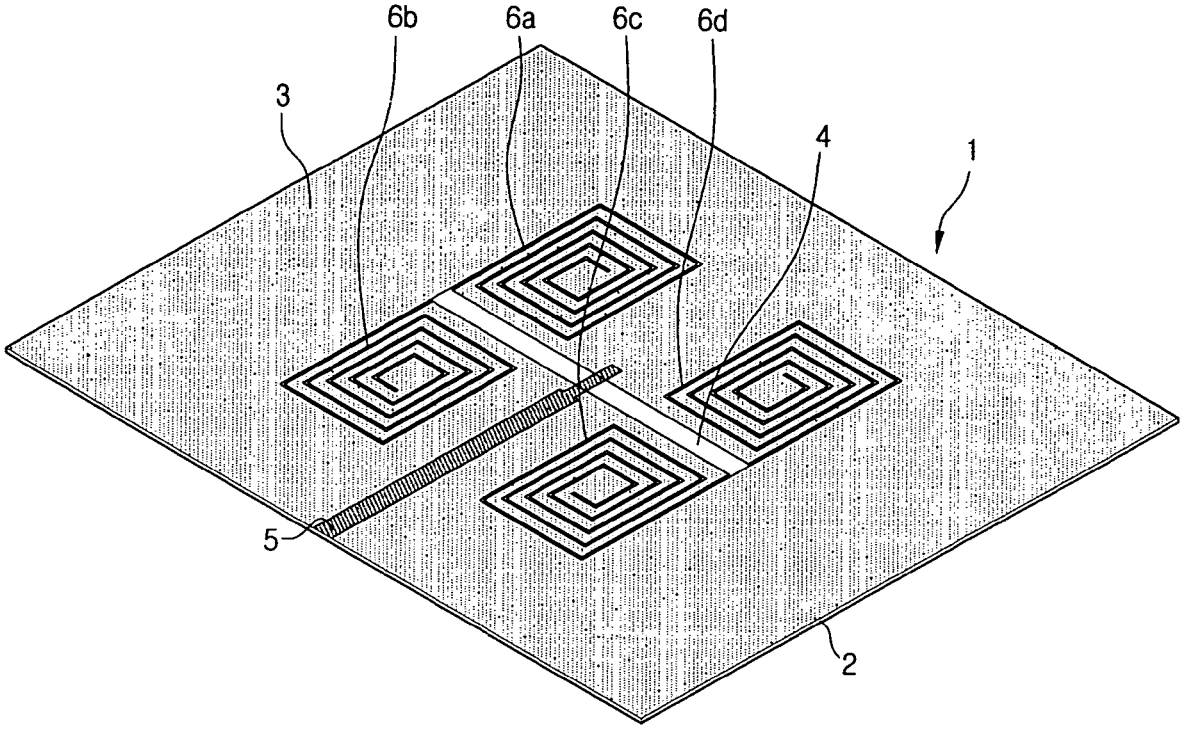
FIG. 1 (PRIOR ART)
FIG. 1 is a view of a prior art antenna.
Figure 2:
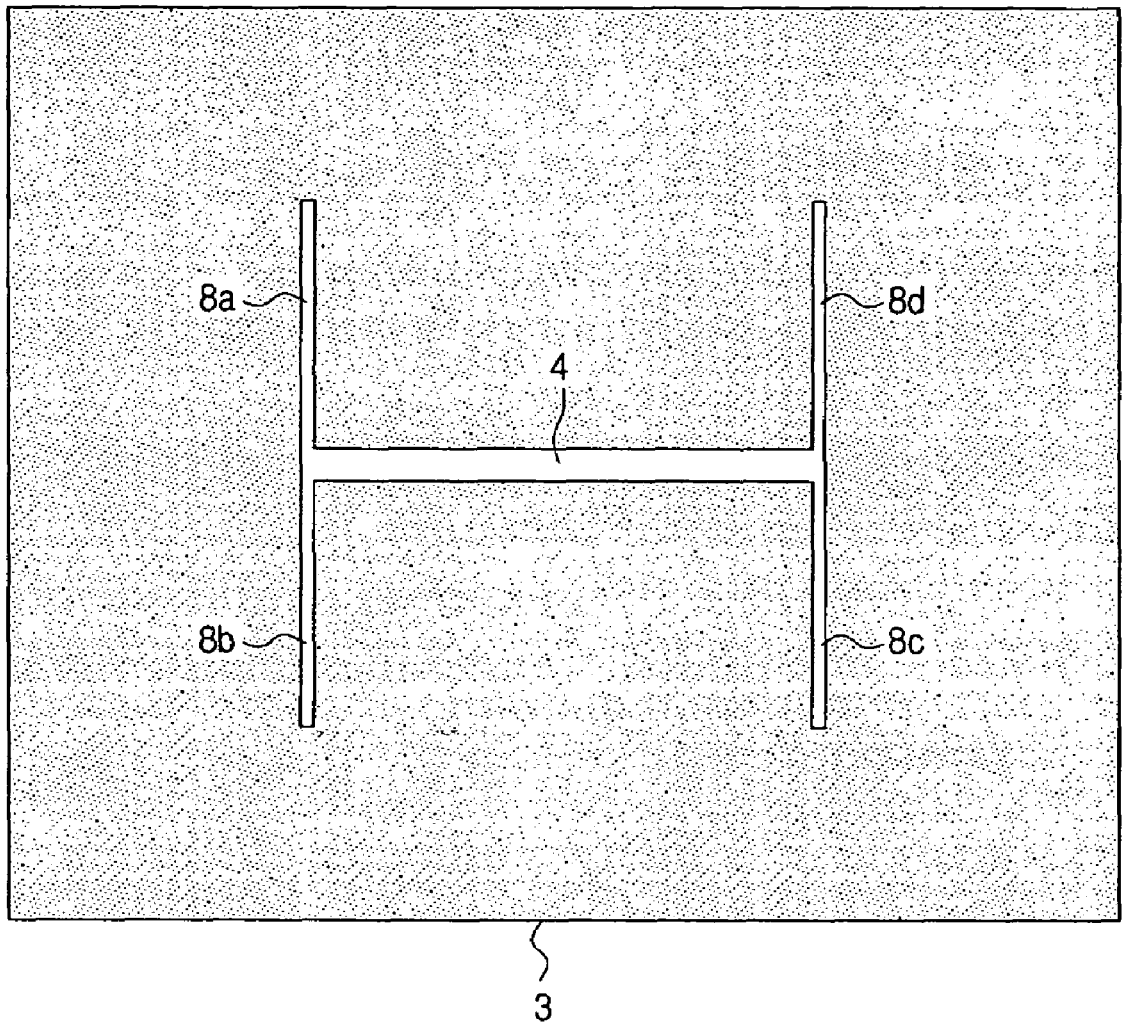
FIG. 2 (PRIOR ART)
FIG. 2 illustrates a radiator of a conventional antenna with a vertically-linear slot.
Figure 3:
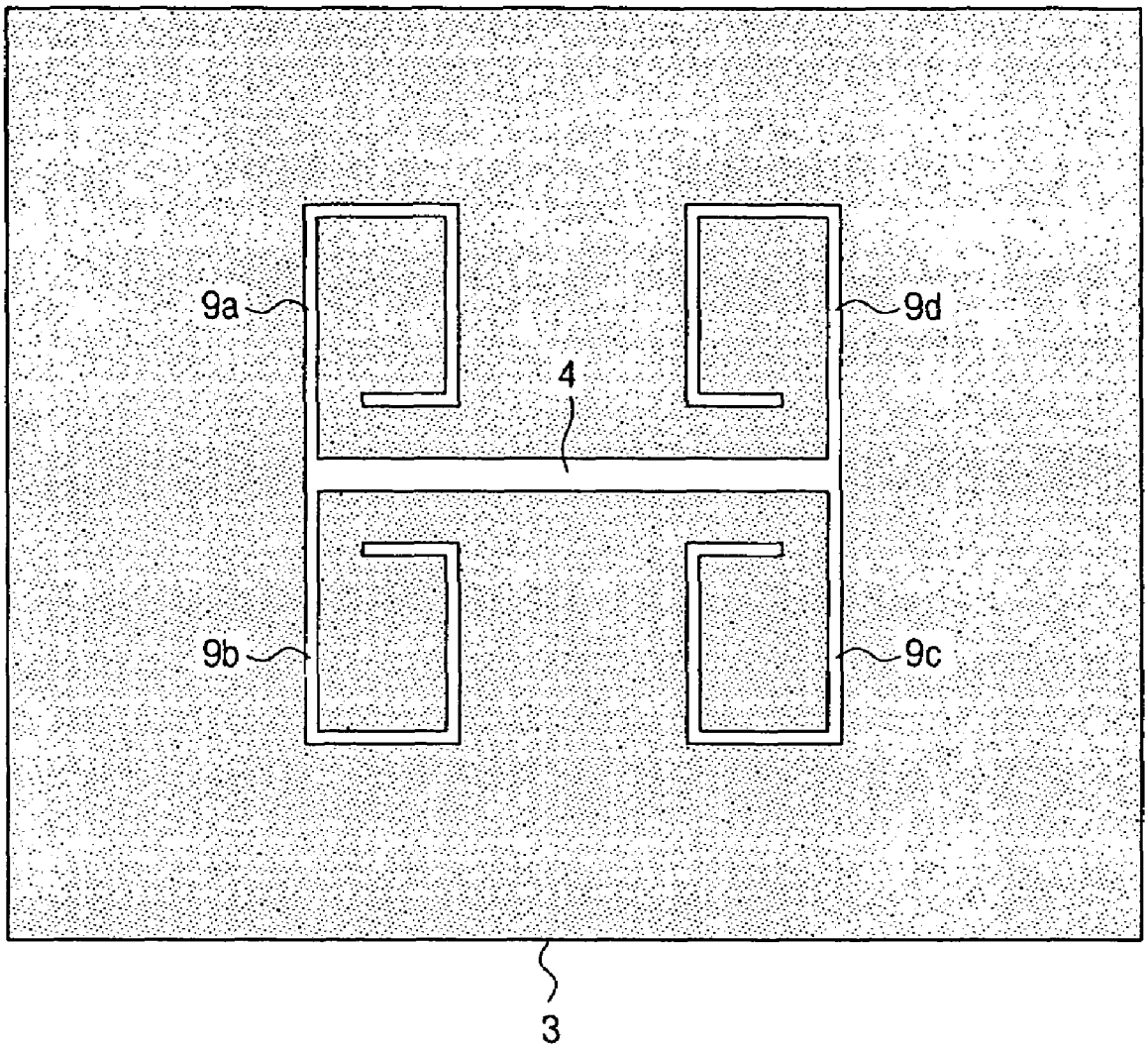
FIG. 3 (PRIOR ART)
FIG. 3 illustrates a radiator of a conventional antenna with a vertically-rotating slot.
Figure 4:
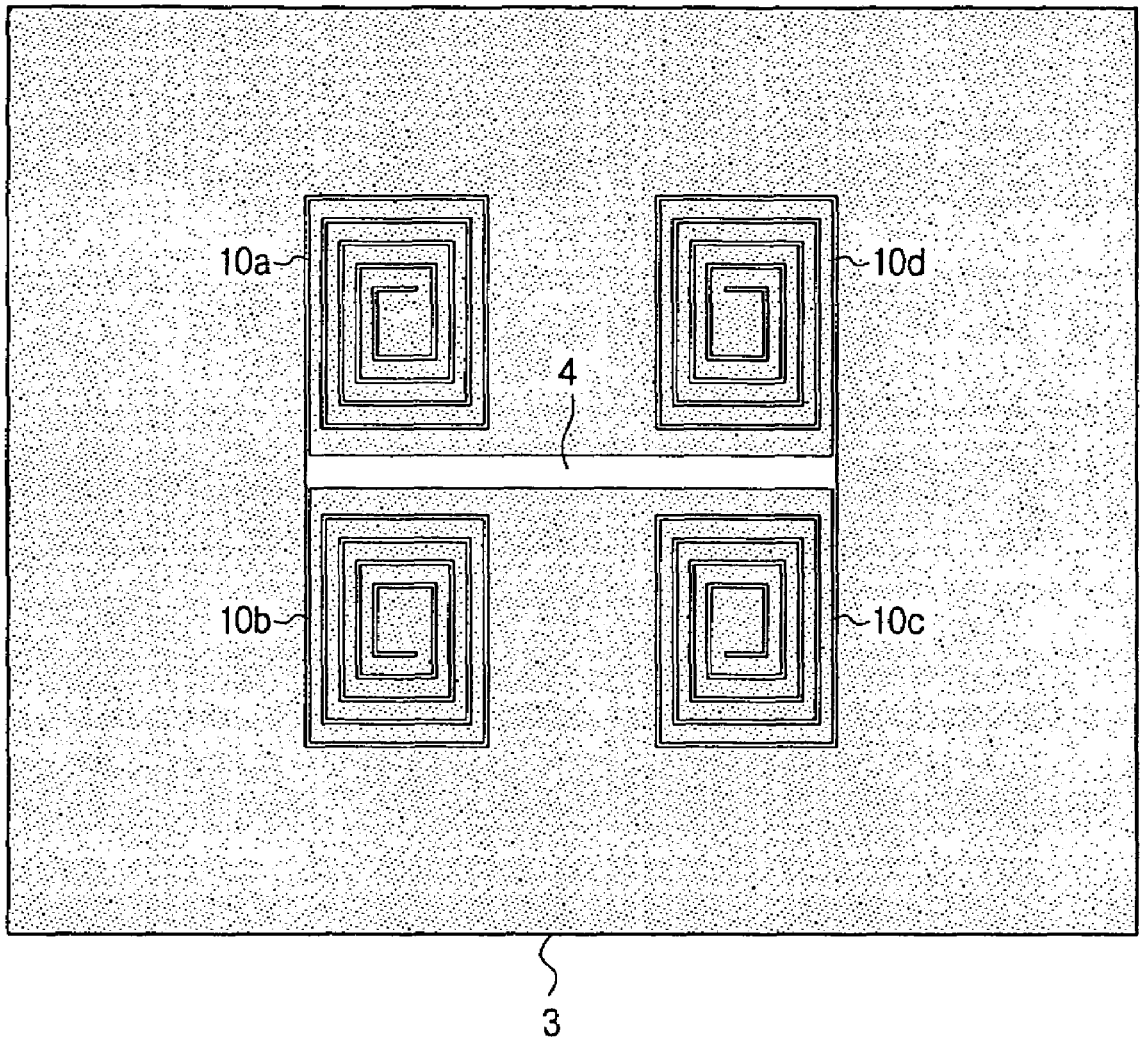
FIG. 4 (PRIOR ART)
FIG. 4 illustrates a radiator with a vertically-spiral slot.

Further, if the length of the termination sub slot is smaller than a quarter of a wavelength, inductive loading is guaranteed. Conventionally, an inductive termination is formed by a pair of linear or spiral slots which are provided at both ends of the main slot 4 (see sub slots 8*a* to 8*d*, 9*a* t 9*d*, 10*a* to 10*d* of FIGS. 2, 3 and 4). Unlike the conventional antennas, in this exemplary embodiment of the present invention, the terminations of the main slot 40 are formed of four sub slots 60*a*, 70*a*, 80*a*, 90*a* terminating at the right side of the main slot 40 and four sub slots 60*b*, 70*b*, 80*b*, 90*b* terminating at the left side of the main slot 40, with the respective sub slots 60*a*, 70*a*, 80*a*, 90*a* and 60*b*, 70*b*, 80*b*, 90*b* being convoluted in a clockwise or counterclockwise mirror-symmetrical pattern.

Figure 7:
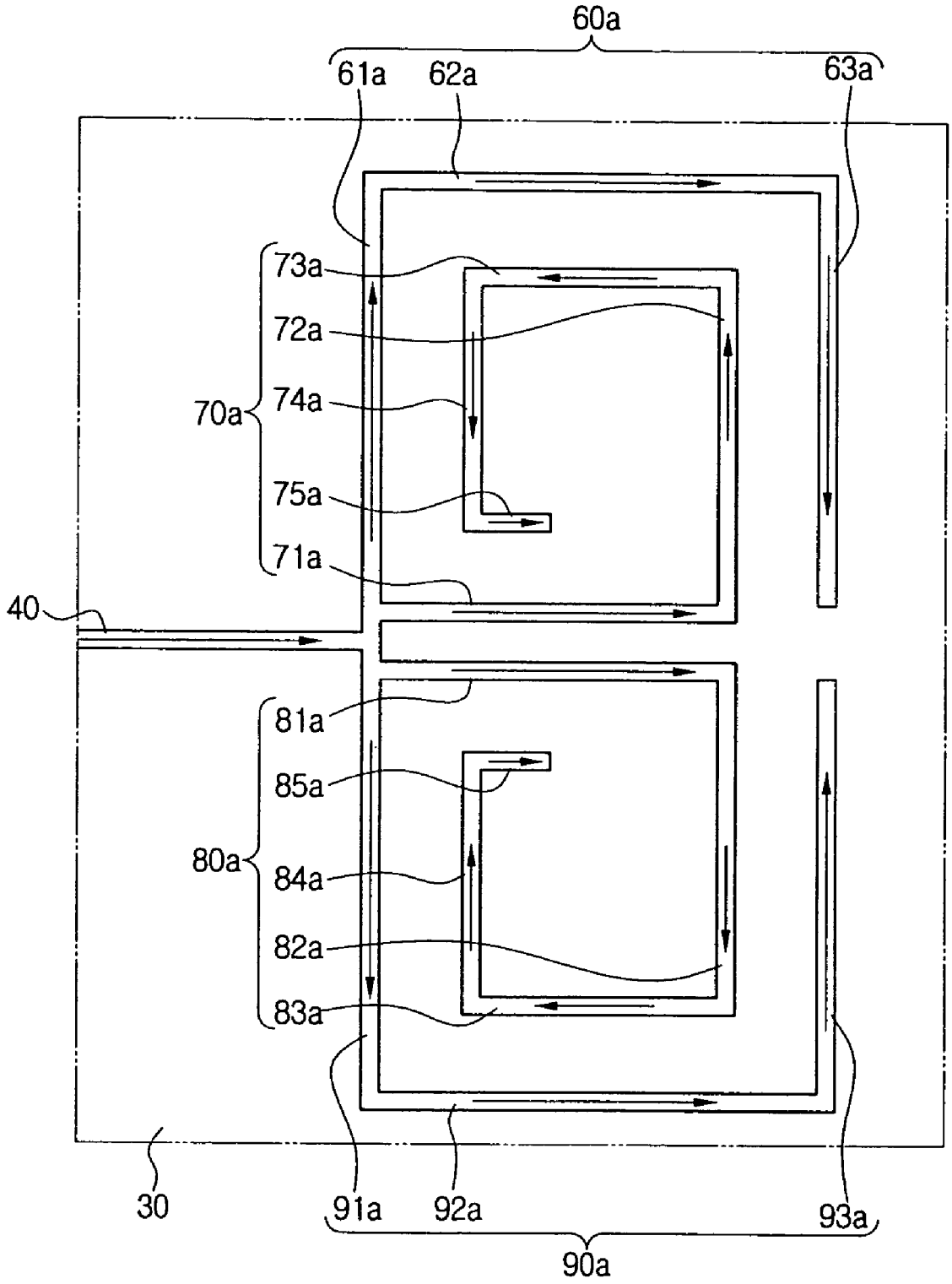
FIG. 7 illustrates distribution of electromagnetic current in the slot pattern according to an exemplary embodiment of the present invention.

FIG. 7 shows the distribution of electromagnetic currents in the slot pattern according to the above exemplary embodiment of the present invention. Referring to FIG. 7, the direction of electromagnetic current is schematically indicated by arrows. By the combination of clockwise and counterclockwise-convoluted sub slots 60*a*, 70*a*, 80*a*, 90*a*, unique electro-magnetic characteristics may be achieved. That is, there are 6 arms 62*a*, 71*a*, 75*a*, 81*a*, 85*a*, 92*a* of convoluted sub slots which have the same electro-magnetic flow as the main slot 40.

In addition, there are two sectors 73*a*, 83*a* which have opposite electro-magnetic flow with respect to the flow direction of the main slot 40. The electromagnetic current has a small amplitude in the two sectors 73*a*, 83*a*.

Meanwhile, an undesirable field coupling effect is initially decreased at the sectors 72*a* and 74*a*, 82*a* and 84*a*, 61*a* and 63*a*, and 91*a* and 93*a*, and is further suppressed by the mirror-symmetry arrangement with respect to the longitudinal axis of the main slot 40.

As a result, undesirable phenomenon due to conventional inductive sub slots can be prevented. Additionally, the area which uses electromagnetic current at the terminating sub slot can be successfully improved, and as a result, increased antenna areas can participate in the radiation efficiently. Therefore, as described above in a few exemplary embodiments of the present invention, a planar small antenna can be provided, which can operate in an improved bandwidth, without adversely affecting the radiation pattern, gain and radiation efficiency.

To compare the performances of the antenna according to an exemplary embodiment of the present invention and the conventional antenna, both antennas were designed to be of an identical size for UHF operation. That is, the metal layer 30 was sized to $0.21\lambda 0 \times 0.15\lambda 0$, and the slot is sized to $0.17\lambda 0 \times 0.08\lambda 0$, where $\lambda 0$ denotes waves in free space.

The feed to the antenna may be an open-ended microstrip line with a probe installed at the rear surface of the dielectric substrate or any other transmission line.

Figure 8:
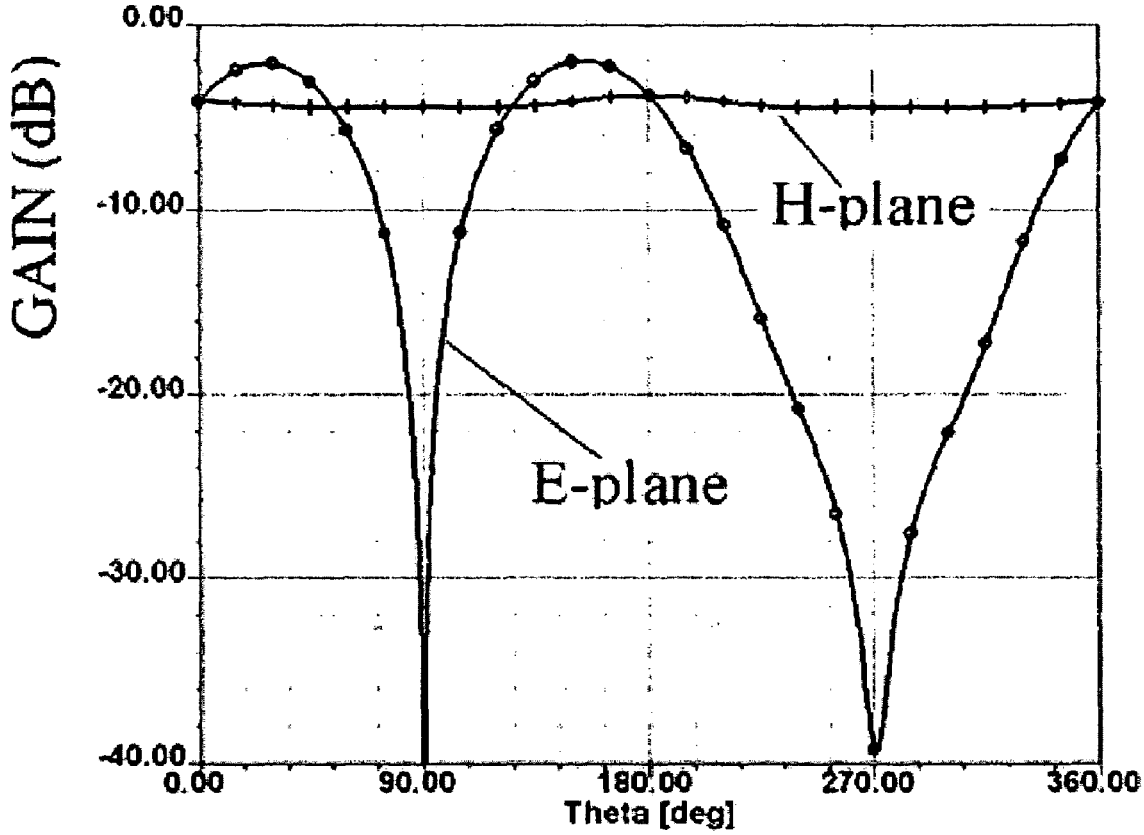
FIG. 8 illustrates radiation pattern on E and H planes of a conventional antenna.
Figure 9:
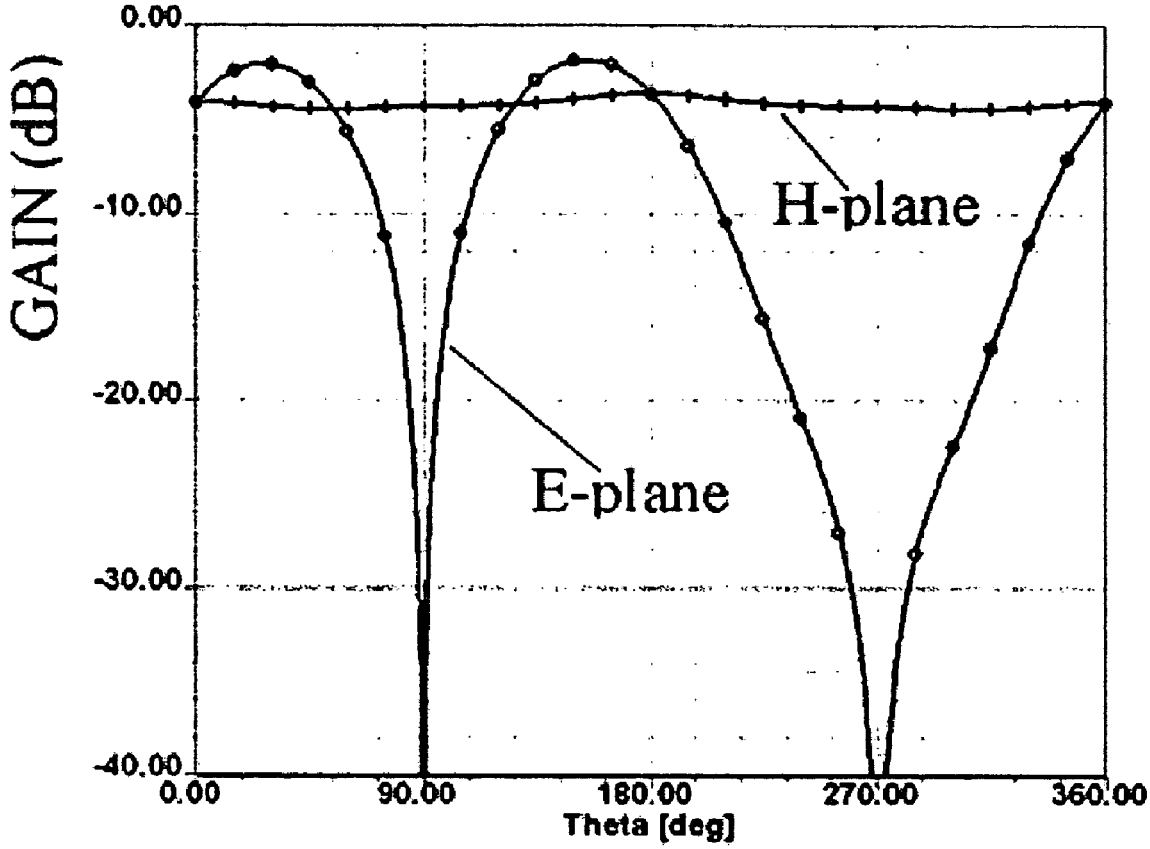
FIG. 9 illustrates radiation patterns on E and H planes of an antenna according to an exemplary embodiment of the present invention.

FIG. 8 shows a radiation pattern on E and H planes of a conventional antenna, and FIG. 9 shows a radiation pattern on E and H planes of an antenna according to an exemplary embodiment of the present invention.

Referring to FIGS. 8 and 9, it was observed that the forward-directional pattern of both antennas are almost similar. The planar small antenna of the present exemplary embodiment has gain of −1.9 dBi, and the conventional antenna has the gain of −1.8 dBi. Accordingly, advantages of the antenna according to this exemplary embodiment of the present invention may not be remarkable in terms of gain and efficiency.

Figure 10:
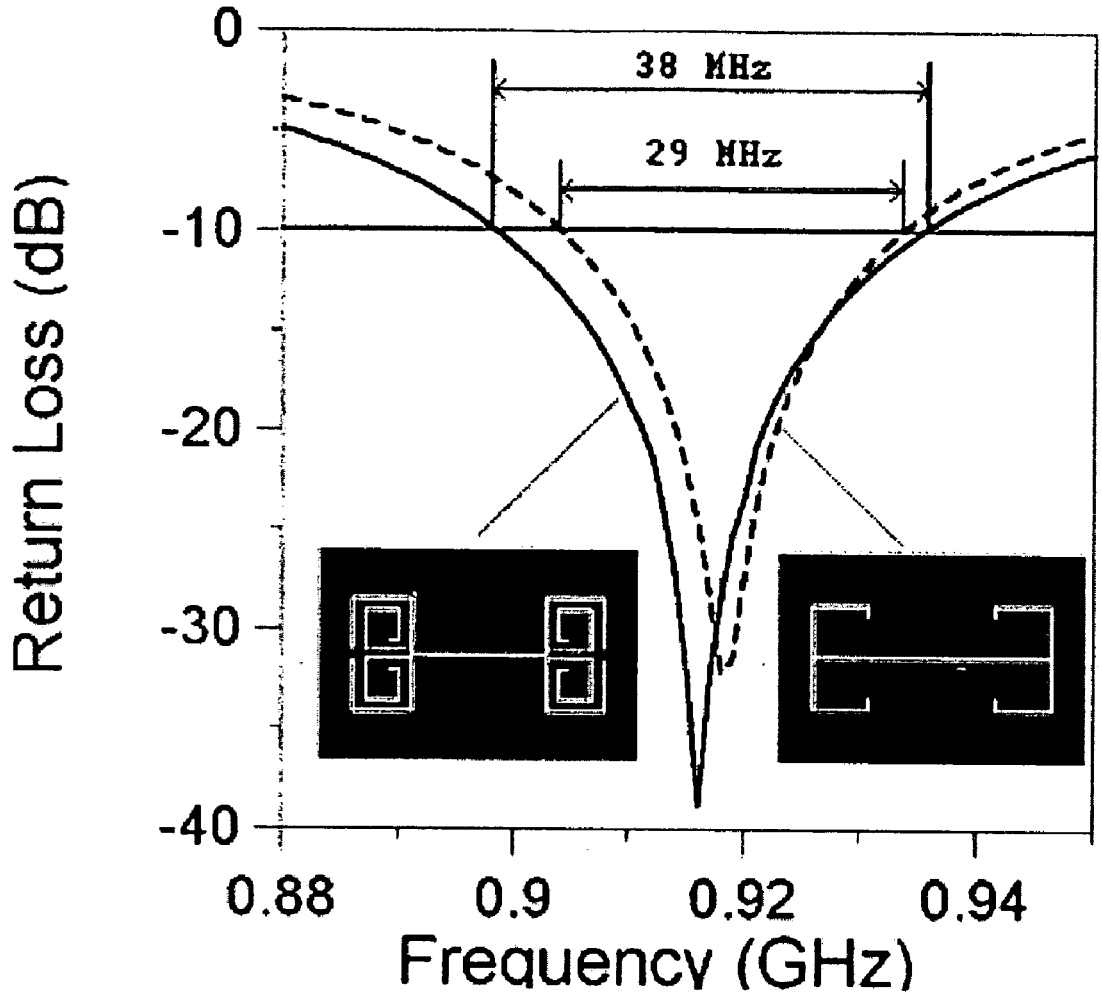
FIG. 10 is a graphical representation comparing bandwidth characteristics through return loss, between a conventional antenna and an antenna according to an exemplary embodiment of the present invention.

FIG. 10 is a graphical representation which compares bandwidth characteristics of an antenna according to an exemplary embodiment of the present invention and a conventional antenna based on return loss. Referring to FIG. 10, the return loss of the conventional antenna is indicated by the phantom line, while the return loss of the antenna according to the present exemplary embodiment is indicated by the solid line.

At the return loss of −10 dB level, the antenna according to the exemplary embodiment of the present invention has operation bandwidth of 38 MHz, while the conventional antenna has operation bandwidth of 29 MHz. In other words, the antenna according to the exemplary embodiment of the present invention has approximately 30% wider bandwidth than the conventional antenna. At the same time, the antenna according to the exemplary embodiment of the present invention does not suffer from the influences on the radiation pattern and efficiency, and polarization purity.

Meanwhile, the antenna 100 according to an exemplary embodiment of the present invention as shown in FIG. 5 requires a substantially large amount of conductive material to form a ground metal layer 30. Additionally, the relatively heavy weight of the metal required by the antenna 100 becomes a factor. Accordingly, it is desirable to provide a radiator which requires less metal or other conductive material, and can operate without adversely affecting the radiation characteristic. Such a radiator is suggested below with reference to another exemplary embodiment of the present invention.

Basically, the radiator characteristic is the dominant characteristic of the electromagnetic characteristics of every antenna. Thus, the maximum area of the radiator should be utilized in the radiation to improve parameters of the antenna. Unlike the radiator with four slot pattern of FIG. 6, a radiator according to another exemplary embodiment of the present invention is based on a strip pattern, because such structure substantially consumes less metal.

The pattern of metal strip geometrically almost duplicates the pattern with four slots as shown in FIG. 6. In other words, according to this particular embodiment of the present invention, the strip replaces the slot on principle of electromagnetic duality. According to this well-known principle, a dual structure can be formed by replacing the metal with air and replacing air with metal. Dual structures are similar to a positive and negative in photography.

The radiator according to this exemplary embodiment of the present invention can be classified as a 'complimentary' radiating structure with respect to the slot pattern-based radiator as shown in FIG. 6. Accordingly, the aspects of the radiator of FIG. 6 are equally applicable to the small strip radiator which will be described below according to another exemplary embodiment of the present invention.

Figure 11:
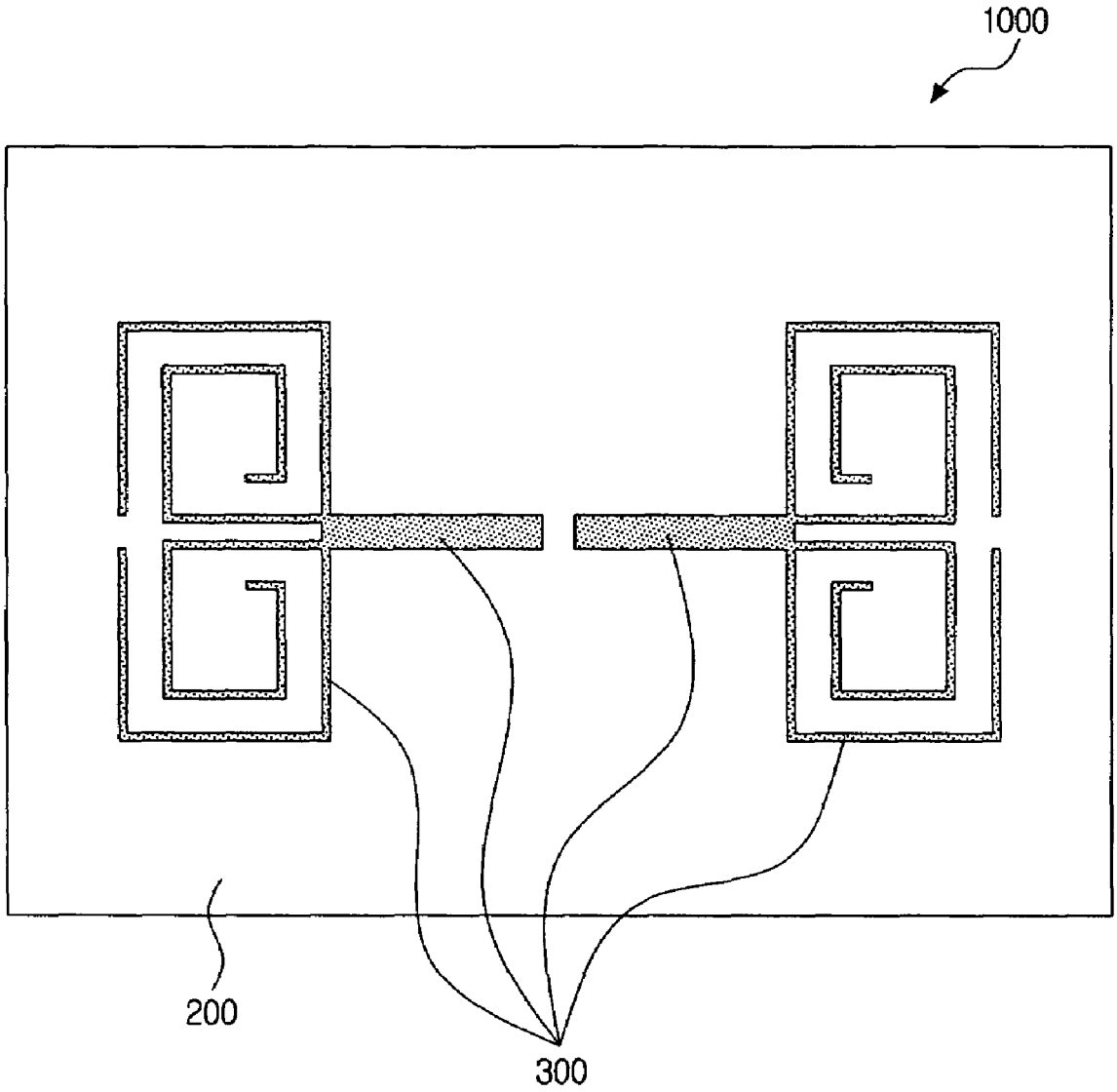
FIG. 11 illustrates small strip radiator according to another exemplary embodiment of the present invention.

FIG. 11 shows a small strip radiator according to another exemplary embodiment of the present invention.

Referring to FIG. 11, a printed strip radiator 1000 includes a dielectric substrate 200 and a conductive strip pattern 300 which is formed on a surface of the dielectric substrate 200. The dielectric substrate 200 directly forms a small strip radiator 1000.

Figure 12:
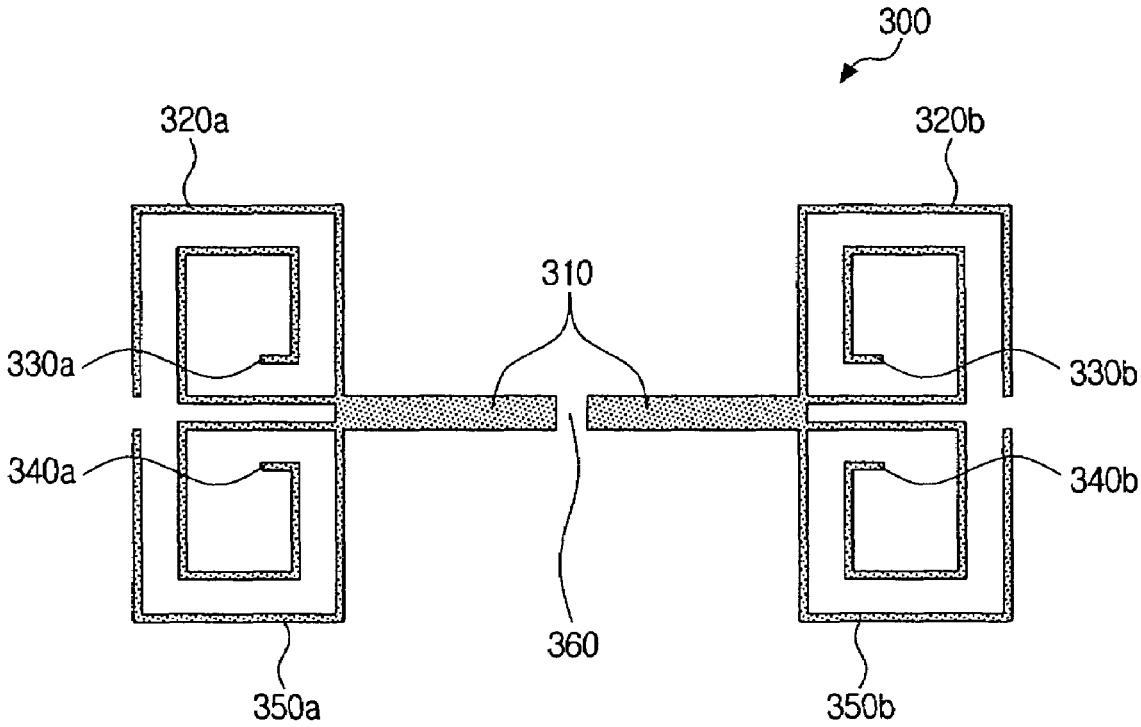
FIG. 12 illustrates in detail strip pattern of FIG. 11.

FIG. 12 shows the strip pattern of FIG. 11 in detail. The strip pattern 300 comprises a main strip 310 and a plurality of strip arms which terminate the main strip 310 at each end. The main strip 310 has a centrally placed gap 360 at feeding point of radiator 1000.

The strip arms 320*a*, 320*b*, 330*a*, 330*b*, 340*a*, 340*b*, 350*a*, 350*b* are arranged in pairs which are arranged with respect to the longitudinal axis of the main strip 310. That is, the strip arms 320*a*, 320*b*, 330*a*, 330*b*, 340*a*, 340*b*, 350*a*, 350*b* terminate the main strip 310 in such a manner that one arm, for example the arm 320*a* is convoluted clockwise while another arm, for example, the arm 320*b* is convoluted counterclockwise. The terminating strip arms are further formed as mirror-symmetrical pairs with respect to the longitudinal axis of the main strip 310.

The size of the metal ground layer 30 of the radiator of FIG. 6 would ideally be infinite. Nonetheless, despite theoretical imperfections of an actual implementation, the radiator 1000 can operate very well, provided that the proper adjustment of the practical strip pattern is taken into account. Of course, the input impedance of the antenna with complimentary radiator would be substantially different and requires proper matching with the particular feeder implementation.

Figure 13:
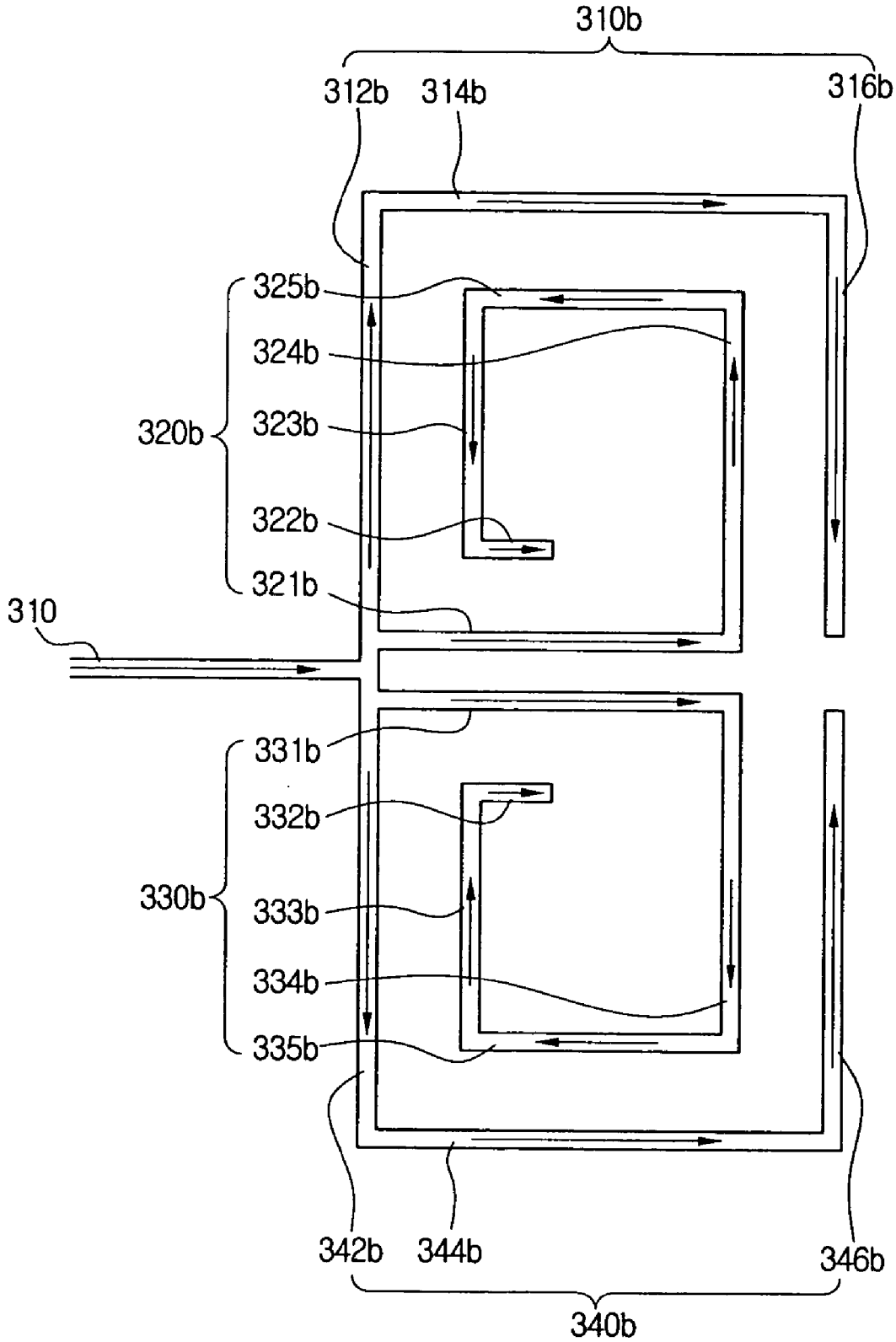
FIG. 13 illustrates a temporary distribution of electric current density in the strip pattern according to an exemplary embodiment of the present invention.

FIG. 13 shows temporary distribution of current density at the strip pattern.

For the case of an electrically small radiator (i.e., small in relation to wavelength), the phase difference of the electromagnetic field along the structure is small, so instantaneous distribution of the electric current density at the strip pattern can be schematically shown by arrows of proportional length as in FIG. 13. The combination of clockwise and counterclockwise convoluted strip arms provides the termination with unique electro-magnetic features.

Namely, there are six sectors 321*b*, 331*b*, 322*b*, 332*b*, 314*b*, 344*b* in FIG. 13 with the flow of the current being in the same direction as at the main strip 310. The opposite flow of the current with substantially low amplitude exists only on two sectors 325*b*, 335*b*.

The undesirable secondary effect of terminating strip arms is suppressed. Indeed, an undesirable far field coupling effect of pairs of sectors 324*b* and 323*b*, 334*b* and 333*b*, 312*b* and 316*b*, and 342*b* and 346*b* is first reduced pair-wise, and then suppressed by the mirror-symmetry with respect to the longitudinal axis of the main strip 310.

Thus, the radiated fields from the strip sectors 324*b*, 323*b*, 312*b*, 316*b* cancel the radiated fields from the sectors 334*b*, 333*b*, 342*b*, 346*b*, and they do not contribute to the overall far field. Additionally, the sectors 321*b*, 331*b*, 322*b*, 332*b*, 314*b*, 344*b* of the vertical strip arms using electric current are successfully improved, thereby increasing the area of antenna that effectively participates in the radiation phenomenon.

The radiator thus functions as a basic element of electrically small planar antenna. The feed of the antenna may be realized either through a conventional planar transmission line, or by direct inlet of an electronic chip into the strip pattern.

As a result, exemplary embodiments of the present invention provide a radiator for electrically small antennas that require less metal or other conductive material than conventional radiators, and at the same time, can operate without adversely affecting the radiation characteristics.

The practical method of manufacturing the radiator involves any sort of printed circuit technologies. The substitution of printed strip pattern by bulk wire pattern with the same generic geometry would also not depart from the scope and spirit of the present invention.

As described above in a few exemplary embodiments of the present invention, a planar small antenna may have increased area to effectively participate in the radiation phenomenon, and therefore, provides improved bandwidth, without adversely affecting the radiation pattern, gain and efficiency.

Additionally, with the small strip radiator according to aspects of the present invention, an electrically small antenna radiator can be provided which requires less metal of conductive material than the conventional radiators, and it also can operate without adversely affecting the radiation characteristics of the antenna.

The foregoing exemplary embodiments and aspects of the invention are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A small planar antenna having an enhanced operating frequency bandwidth, comprising:

a dielectric substrate;

a metal layer formed on an upper part of the dielectric substrate;

a main slot formed in pattern on the metal layer; and a plurality of sub-slots connected to the main slot and winding in a specified direction;

wherein the plurality of sub-slots are arranged symmetrically with reference to a longitudinal axis of the main slot, and each comprises:

a first sub-slot extending in a coil from the main slot; and a second sub-slot which is coiled opposite to the first sub-slot, formed alongside an inner side of the first sub-slot.

2. The small planar antenna as claimed in claim 1, wherein the specified direction is either of clockwise and counterclockwise directions.

3. The small planar antenna as claimed in claim 1, wherein the plurality of sub-slots that form a pair of symmetric sub-slot groups around the longitudinal axis of the main slot wind in opposite directions to each other.

4. The small planar antenna as claimed in claim 1, wherein a length of a winding arm of the sub-slots is smaller than ¼ of a wavelength at operating frequency of the antenna.

5. The small planar antenna as claimed in claim 1, wherein the plurality of sub-slots comprise:

a right-side first sub-slot winding clockwise from a right-side upper end part of the main slot;

a right-side second sub-slot winding in an opposite direction to the right-side first sub-slot from an inside of the right-side first sub-slot;

a right-side fourth sub-slot winding in an opposite direction to the right-side first sub-slot from a right-side lower end part of the main slot; and a right-side third sub-slot winding in an opposite direction to the right-side fourth sub-slot from an inside of the right-side fourth sub-slot.

6. The small planar antenna as claimed in claim 5, wherein the plurality of sub-slots further comprise:

a left-side first sub-slot winding counterclockwise from a left-side upper end part of the main slot;

a left-side second sub-slot winding in an opposite direction to the left-side first sub-slot from an inside of the left-side first sub-slot;

a left-side fourth sub-slot winding in an opposite direction to the left-side first sub-slot from a left-side lower end part of the main slot; and a left-side third sub-slot winding in an opposite direction to the left-side fourth sub-slot from an inside of the left-side fourth sub-slot.

7. The small planar antenna as claimed in claim 1, wherein a length of the main slot is smaller than a half wavelength at an operating frequency of the antenna.

8. The small planar antenna as claimed in claim 1, wherein a width of the sub-slots is the same as that of the main slot.

9. The small planar antenna as claimed in claim 1, wherein a width of the sub-slots is narrower than that of the main slot.

10. The small planar antenna as claimed in claim 1, wherein a width of the sub-slots is wider than that of the main slot.

11. The small planar antenna as claimed in claim 1, further comprising a feeder having a microstrip line composed of an open-ended capacitive probe provided on a rear surface of the dielectric substrate.

12. The small planar antenna as claimed in claim 11, wherein a width of the probe is the same as that of a strip width of the microstrip line.

13. The small planar antenna as claimed in claim 11, wherein a width of the probe is narrower than that of a strip width of the microstrip line.

14. The small planar antenna as claimed in claim 11, wherein a width of the probe is wider than that of a strip width of the microstrip line.

* * * * *